US005301982A

United States Patent [19]

Brotz

[11] Patent Number: 5,301,982

[45] Date of Patent: Apr. 12, 1994

[54] SELF-ILLUMINATING SHEET/BOOK PAGE

[76] Inventor: Gregory R. Brotz, P.O. Box 1322, Sheboygan, Wis. 53081

[21] Appl. No.: 892,268

[22] Filed: Jun. 2, 1992

Related U.S. Application Data

[63] Continuation-in-part of Ser. No. 765,517, Sep. 25, 1991, Pat. No. 5,118,138.

[51] Int. Cl.[5] ..... B42D 15/00

[52] U.S. Cl. ..... 283/83; 40/442

[58] Field of Search ..... 281/51, 2, 38; 40/442, 40/546, 204; 283/83

[56] References Cited

U.S. PATENT DOCUMENTS

| | | | |
|---|---|---|---|
| 1,854,418 | 4/1932 | Morrison | 40/441 |
| 2,232,815 | 2/1941 | Van Ausdall | 40/441 |
| 4,286,399 | 9/1981 | Funahashi et al. | 40/442 X |
| 4,363,081 | 12/1982 | Wilbur | 40/442 X |
| 4,475,298 | 10/1984 | Munoz | 40/442 X |
| 4,667,427 | 5/1987 | Been | 40/442 |
| 5,118,138 | 6/1992 | Brotz | 281/51 |

*Primary Examiner*—Mark Rosenbaum
*Assistant Examiner*—Willmon Fridie, Jr.
*Attorney, Agent, or Firm*—William Nitkin

[57] ABSTRACT

A sheet or page of a book being self-illuminating, each such sheet utilizing electroluminescent polymer film to be illuminated as indicia or, in an alternate embodiment, as background for indicia.

3 Claims, 1 Drawing Sheet

SELF-ILLUMINATING SHEET/BOOK PAGE

This application is a continuation-in-part of my previous application for a Self-illuminating Book, Ser. No. 07/765,517 filed Sep. 25, 1991, now U.S. Pat. No. 5,118,138.

BACKGROUND OF THE INVENTION

1. Field of the Invention

The structure of this invention relates to a sheet or page of a book which can be read without the necessity of ambient light and more particularly relates to sheets or pages of a book having illumination incorporated within such sheets or pages.

2. Description of the Prior Art

It has been appreciated by non-braille readers that in order to read a non-braille book, one must have ambient light from an external light source to reflect off the pages of such book. Applicant in his previous application has disclosed a book having a built-in light source for illumination of the pages from within.

SUMMARY OF THE INVENTION

It is a goal of this invention to provide a sheet or pages of a book that are self-illuminated so that the individual sheet or book page can be read without any ambient light present. This invention is useful in dark areas such as encountered during the night or in areas lacking natural or artificial light.

One embodiment of the structure of the sheet or page of this invention provides for a base sheet of planar material having disposed thereon a film of electroluminescent polymer extending between two side electrodes. On the electroluminescent polymer film is imprinted opaque or translucent indicia such as letters, numbers or other subject matter, such as maps, which block or change the color of the light from the glowing electroluminescent polymer film and such indicia stand out and become visible to an observer. In this way, printing and illustrations, such as found in books, can be seen as they are distinguishable from the brighter background. The base sheet on which such film is positioned can form the pages of a book, and in one embodiment such base sheet can be opaque and have on its opposite side a second electroluminescent polymer film also with indicia either imprinted or placed thereon with electrical current from side electrodes provided thereacross to illuminate the film and make the indicia thereon visible.

In a further embodiment of this invention a base sheet can be provided on which is imprinted a printed circuit over which is positioned, or on which is imprinted, various indicia formed of electroluminescent ink or film which when electrical current passes through the printed circuit, such indicia is illuminated while the background remains dark.

DESCRIPTION OF THE PREFERRED EMBODIMENT(S)

Figure 1:
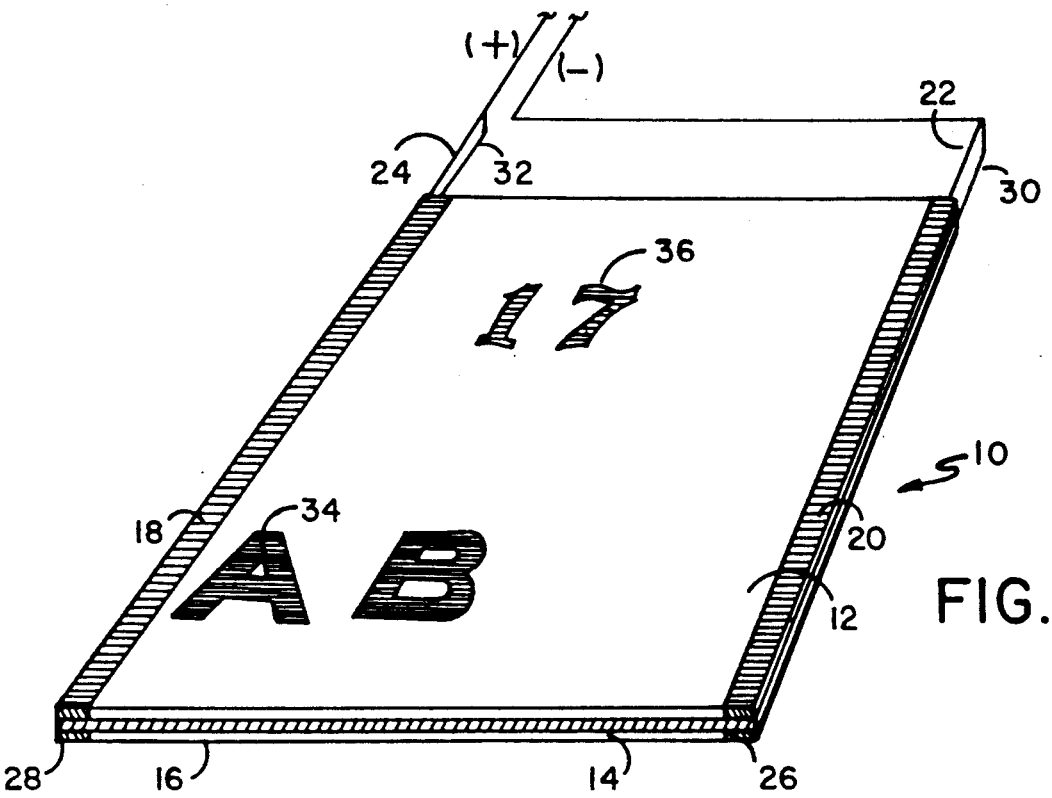
FIG. 1 illustrates a perspective view of a sheet or page having an electroluminescent polymer film thereon overlaid with opaque indicia.

FIG. 1 illustrates a perspective view of an individual sheet or page 10 of a book having an opaque base 14 on top of which is disposed a layer of electroluminescent film 12. Electroluminescent polymer films are known in the prior art and can be made of a plurality of conjugated polymers such as poly(p-phenylenevinylene). Other copolymers which exhibit the same electroluminescence can also be used in this invention. On the rear of base 14 can be disposed another layer of electroluminescent film 16, an edge of which is seen in FIG. 1. It should be noted when discussing this invention that the words "sheet" and "page" should be considered to be interchangeable because a plurality of sheets can be bound as pages in a book. At the side edges of electroluminescent polymer film 12 are first and second side edge electrodes 18 and 20 which have electrical current directed thereto through first and second electrical lines 22 and 24 providing opposite current poles at each side of electroluminescent polymer film 12. When current is provided through these lines, electroluminescent polymer film 12 glows and opaque or translucent indicia such as letters 34 or numbers 36 placed thereon become readily visible to an observer even in the dark as these letters or numbers or color change stand out against the illuminated electroluminescent polymer film. For example, black indicia could be utilized. If blue translucent indicia were used over a yellow glowing electroluminescent polymer film, the indicia would appear green. Other combinations of colored indicia and film can be utilized. In a similar manner on the rear of base 14 is electroluminescent polymer film 16 are third and fourth side edge electrodes 26 and 28 receiving current through third and fourth electrical lines 30 and 32, respectively.

Figure 2:
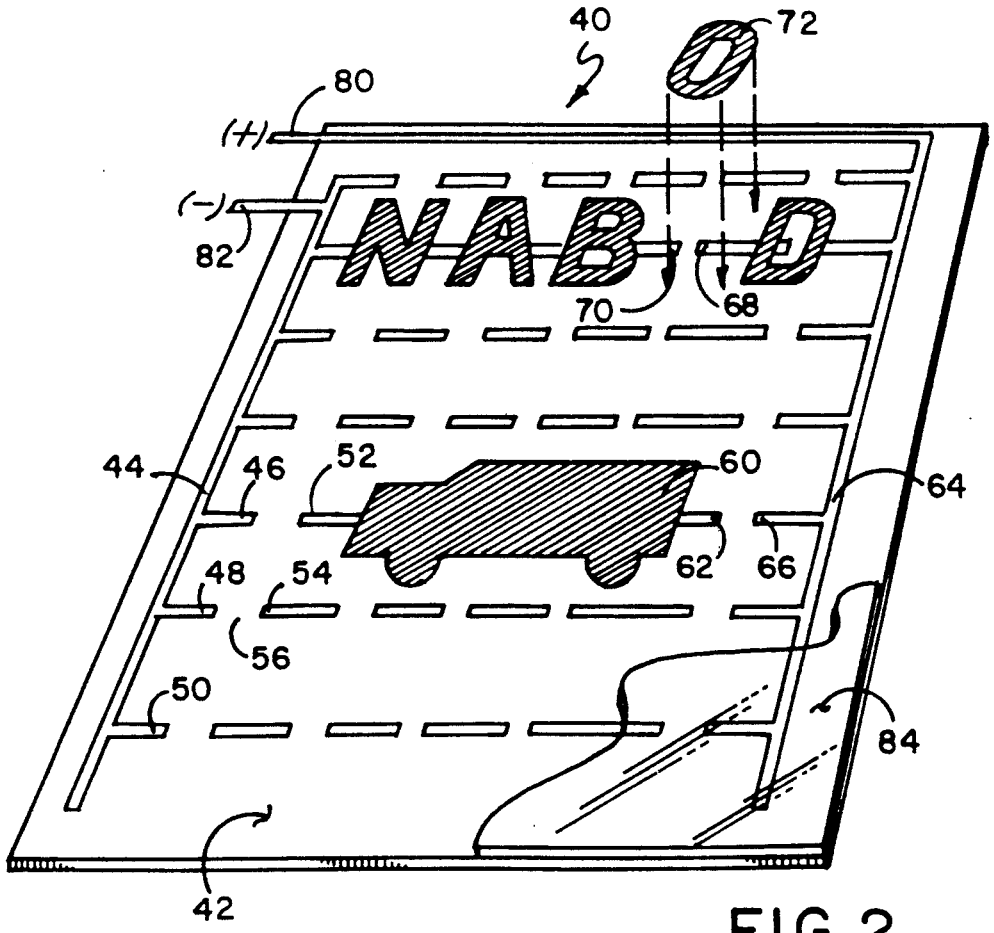
FIG. 2 illustrates a perspective view of a sheet or page having a printed circuit thereon on which is overlaid electroluminescent polymer film indicia.

In an alternate embodiment a base material 42 can be utilized to create a page or sheet 40 with a printed circuit 50 thereon which printed circuit can be made of a dark conductive material and have side electrodes 44 and 64 extending down the side edge of sheet 40 with a plurality of spaced apart elements such as elements 48 and 54 having space 56 therebetween and other elements continuing in line extending across the page such that when indicia made of electroluminescent polymer film such as letter 72 is positioned over a pair of adjacent elements such as elements 68 and 70, a circuit is completed which if electroluminescent polymer film indicia are positioned across the entire row of printed circuit elements when current is provided to side electrodes 44 and 64, will direct current through such electroluminescent polymer indicia, such as for example the NABOD as seen in FIG. 2, causing such indicia to glow. Other shaped electroluminescent polymer film indicia can be used such as truck shape 60 which is positioned between elements 52 and 62, but it should be noted that before truck shape 60 could be illuminated, other electroluminescent polymer film indicia would have to be positioned in the open areas between elements 46 and 52 and elements 62 and 66 in order to complete a circuit for electrical current to pass through all the indicia. In an alternate embodiment the printed circuit can be provided in a particular arrangement to accommodate the desired shape of the electroluminescent polymer film indicia to be placed thereover. In such embodiment the printed circuit can be printed on base material 42, and the electroluminescent polymer film indicia can be either printed thereover when using electroluminescent polymer ink or placed thereover if using an electroluminescent polymer film cut to the shape desired having sufficient structural integrity to retain its shape during its placement over the printed circuit elements. The entire structure of the base material, printed circuit, and electroluminescent polymer film indicia can be overlaid with a transparent plastic sheet 84 or sprayed with a plastic or equivalent coating so as to protect and retain the indicia and to prevent any foreign object or substance from shortcircuiting the printed circuit by contact therewith. The structure shown in FIG. 2 can also be provided on the rear of base material 42 with the electrical source to positive and negative leads 80 and 82, respectively, provided from batteries or equivalent power source located, for example, in the spine of a book with a plurality of such pages being provided to form a book to be self-illuminated for reading in the dark.

The structure of this invention when used with low voltage can also be utilized as a children's toy or game.

Although the present invention has been described with reference to particular embodiments, it will be apparent to those skilled in the art that variations and modifications can be substituted therefor without departing from the principles and spirit of the invention.

I claim:

1. A sheet, comprising:

a base sheet;

a layer of electroluminescent polymer film having first and second side edges, said layer disposed on said base sheet;

a first electrode contacting said first side edge of said layer of electroluminescent polymer film;

a second electrode contacting said second side edge of said layer of electroluminescent polymer film;

means to provide electrical current to said first and second electrodes to cause said layer of electroluminescent polymer film to illuminate; and non-transparent indicia disposed on said layer of electroluminescent polymer film, said indicia visible when said layer of electroluminescent polymer film is illuminated.

2. A sheet, comprising:

a planar base;

a printed circuit disposed on said base, said circuit having a plurality of conductive elements disposed thereon with adjacent elements having a space defined therebetween;

means to provide electrical current to selected of said elements; and conductive electroluminescent polymer indicia placed on top of at least two of said elements, said electroluminescent polymer indicia being in electrical contact with said elements, said indicia covering over the space between said elements, said indicia to be illuminated and to be visible when electrical current is provided to said conductive elements.

3. The structure of claim 2 having a transparent layer disposed thereover.

* * * * *